United States Patent [19]

Neu et al.

[11] 3,943,270

[45] Mar. 9, 1976

[54] AQUEOUS FLUX FOR HOT DIP GALVANISING PROCESS

[75] Inventors: Max Gerhard Neu; Arthur William Murcott, both of Birmingham, England

[73] Assignee: Foseco International Limited, Birmingham, England

[22] Filed: Feb. 25, 1974

[21] Appl. No.: 445,550

[30] Foreign Application Priority Data

Mar. 1, 1973 United Kingdom ..... 10075/73

[52] U.S. Cl. ..... 427/310; 148/23; 148/26; 427/321; 427/433

[51] Int. Cl.[2] ..... C23L 1/12

[58] Field of Search ..... 148/23, 26; 117/50, 51, 117/52, 114 A; 427/310, 321, 433

[56] References Cited

UNITED STATES PATENTS

| | | | |
|---|---|---|---|
| 2,706,161 | 4/1955 | Westby | 148/26 X |
| 2,940,870 | 6/1960 | Baldwin | 117/114 A X |
| 3,030,241 | 4/1962 | Brightly | 148/23 |
| 3,723,160 | 3/1973 | Tanaka et al. | 117/50 |
| 3,728,783 | 4/1973 | Chartet | 148/26 X |
| 3,740,275 | 6/1973 | Heins | 148/26 |
| 3,754,897 | 8/1973 | Derham | 148/26 X |

FOREIGN PATENTS OR APPLICATIONS

| | | |
|---|---|---|
| 803,316 | 10/1958 | United Kingdom |

*Primary Examiner*—Ralph S. Kendall
*Assistant Examiner*—John D. Smith
*Attorney, Agent, or Firm*—Cushman, Darby & Cushman

[57] ABSTRACT

Galvanising fluxes consisting of zinc chloride, one or more of sodium, potassium, calcium and magnesium chlorides, and an acid or acid salt (preferably aluminium chloride). In solution in water, the pH of the solution is less than 5.

7 Claims, No Drawings

AQUEOUS FLUX FOR HOT DIP GALVANISING PROCESS

This invention concerns hot dip galvanising processes for ferrous metals and fluxes for use in such processes.

In hot dip galvanising, ferrous metals or alloys, particularly cast iron or mild steels, are treated to prevent corrosion. The hot dip galvanising process involves dipping a ferrous metal article having a surface which is chemically clean into molten zinc, which may contain minor quantities of other elements, in order to coat the surface of the article with a protective layer of zinc. The coating formed adheres as a result of alloying taking place at the ferrous metal - zinc interface.

In order to secure satisfactory alloying of the molten zinc onto the ferrous metal surface, it is necessary to pretreat the ferrous metal surface by cleaning the surface scrupulously and by providing fluxing agent on the surface to promote intermetallic contact.

Thus, in order to prepare articles for hot dip galvanising, the first step is to subject the articles to a cleaning cycle in order to give a chemically clean surface.

The initial steps in the cleaning cycle may include degreasing, for example using trichlorethylene vapour and/or an aqueous alkaline solution, and possibly shot or grit blasting. Acid pickling is usually also carried out. After these cleaning treatments, the article is subjected to a flux treatment using a chemical salt or a mixture of chemical salts. The fluxing treatment immediately precedes galvanising, and is the step which ensures wetting of the surface being coated by the molten zinc.

In the early years of the hot dip galvanising process, the fluxing material was provided by iron salts which remained on the ferrous metal surface after pickling. More recently, processes have been developed, of which there are two main types which employ a separate fluxing agent: the two types differ from each other in the manner in which the fluxing agent is applied. In one, the so-called "Wet Process" the ferrous metal articles are pickled, sometimes rinsed, and then dipped into molten zinc through a layer of molten flux, usually ammonium chloride, which floats on the surface of the zinc. In the other, the so-called "Dry Process" a layer of flux is dried on to the ferrous metal article to be galvanised after the article has been dipped into an aqueous solution of the flux. The article with flux on its surface is then dipped into molten zinc. The most common flux employed in the "Dry Process" is zinc ammonium chloride.

In some cases combinations of "Wet" and "Dry" processes are employed, i.e. a flux is applied by the dry process and the articles are passed into the bath through a molten flux cover on the surface of the bath.

With legislative requirements becoming more stringent there is a need for galvanising processes to be improved, especially in respect of fume evolution, whilst maintaining or improving the quality of the galvanised product.

Both commonly used fluxing agents noted above suffer from the disadvantages that they evolve copious fume. Fume is less evident using zinc ammonium chloride and in consequence zinc ammonium chloride has in some cases replaced ammonium chloride in the "Wet Process." Usually zinc ammonium chloride is employed in the "Dry Process" and because of this fact and the very nature of the operation of the "Dry Process" there is considerably less atmospheric pollution than from the "Wet Process." However, it is desirable further to reduce the fume evolved in the "Dry Process."

A number of fluxing agents which produce little fume have been proposed in the past but generally these fluxing agents have been used in the "Wet" process. The application of these fluxing agents in the dry process has met with limited success, probably due to the difficulty of obtaining and maintaining stable solutions after dissolution of the fluxing agents in water. Fluxes containing compounds such as zinc chloride will dissolve in water, particularly at elevated temperatures, but the solution produced is unstable, and precipitation of complex metal hydroxides and oxychlorides frequently takes place, thus reducing the proportion of active fluxing agent in the solution. Use of such degraded solutions leads to incomplete galvanising of ferrous articles, particularly at corners, on edges and where a degree of surface roughness predominates. The reason is not clear, but it is possible that precipitates in the preflux are electrochemically attracted to certain areas of an article thereby stifling the fluxing action, and subsequently preventing intimate contact at the iron/molten zinc interface or that the flux solution becomes denuded of active constituents and therefore does not flux adequately.

It has now been found that by reducing the pH value of certain flux solutions to below 5, precipitation of metal hydroxides can be prevented, and stable solutions can be made up which can be used successfully in the dry process.

According to a first feature of the present invention there is provided a galvanising flux comprising:

i. at least 25 percent by weight of zinc chloride,
ii. one or more chlorides of sodium, potassium, calcium and magnesium, and
iii. an acid and/or an acidic salt as hereinafter defined, the proportions and ingredients being such that when such a flux is placed in water at a concentration of 25 percent by weight, the pH of the solution is less than 5.

By acidic salt we mean a salt which, when dissolved in water, at a concentration of 1.25 percent by weight, gives a solution having a pH of less than 5.

According to a further feature of the invention there is provided a galvanising flux solution comprising a flux as just defined, and water. Preferably the concentration of flux in such a solution is 3.0 to 30 percent by weight.

According to a further feature of the invention there is provided a process of hot dip galvanising which comprises covering the surface of a ferrous metal article with a flux solution as just defined, optionally drying the article, so as to leave a layer of flux on the surface of the article, immersing the article in molten zinc, or zinc alloy, removing the article therefrom and allowing the molten zinc or zinc alloy on the surface of the article to solidify.

Suitable acids for use as component iii) include mineral acids e.g. HCl, HF, $H_2SO_4$, and organic acids e.g. acetic acid.

Suitable acidic salts for use as component iii) include aluminum sulphate, soda alum and potash alum, potassium bisulphate, sodium bisulphate, aniline hydrochloride, ferrous chloride, ferric chloride, sodium aluminium chloride, triethanolamine hydrochloride, and aluminium chloride.

The galvanising fluxes preferably have the following composition by weight:

| | |
|---|---|
| zinc chloride | 30 – 80% |
| sodium and/or potassium chloride | 0 – 69% |
| calcium chloride and/or magnesium chloride | 0 – 35% |
| acid and/or acidic salt | not less than 2% most preferably at least 5% and not more than 30% |

The flux compositions may also contain known fluxing agents such as zinc ammonium chloride and/or ammonium chloride. However, such fluxing agents increase the amount of fume evolved from the flux during the galvanising process so it is desirable that the flux compositions contain no more than about 20 percent of such fluxing agents.

The flux compositions may also contain a surfactant to assist wetting of the surface of the ferrous metal article during treatment with the flux. The flux composition may also contain a flocculating agent to maintain a clear flux solution. Suitable surfactants include fatty amines condensed with ethylene oxide and suitable flocculating agents are polyacrylamide, preferably unhydrolysed polyacrylamide.

The selection of such materials may be made without difficulty. The proportions of surfactants and flocculating agents are generally less than 1 percent by weight.

In addition to producing stable solutions when dissolved in water the fluxes of the invention have low fume characteristics. Flux compositions of the invention have another advantage in that compared with normal practice the concentration of the aqueous fluxing solution can be lower; indeed with many prior art fluxes the concentration is 20 to 50 percent by weight.

The following examples will serve to illustrate the invention.

EXAMPLE 1.

A flux was prepared having the following composition by weight:

| | |
|---|---|
| zinc chloride | 49% |
| potassium chloride | 26% |
| sodium chloride | 10% |
| aluminium chloride | 15% |

The flux was dissolved in water to give a 30 percent by weight solution having a density of 1.15 gm/cc.

Steel articles were shot-blasted, pickled in 15 percent hydrochloric acid, rinsed in water, and immersed in the flux solution at 65° – 75°C for 15 minutes. The articles were removed and allowed to dry and they were then immersed in molten zinc for 2 – 3 minutes at 450° – 460°C. Little fume was evolved. After removal from the bath of molten zinc and on solidification of the zinc the articles exhibited a bright galvanised finish. Bend tests on samples of the galvanised articles showed the galvanised coatings to be more ductile than coatings produced using a zinc ammonium chloride flux in that they showed a reduced tendency to crack and spall, probably as a result of a thinner alloy layer at the zinc/iron interface.

Similar tests were carried out with flux solutions down to a density of only 1.025 gm/cc. Galvanising was successfully carried out at this low density but it was found that articles must be galvanised soon after fluxing to avoid superficial rusting. Solutions of density 1.045 gm/cc and above were more reliable.

EXAMPLES 2 to 5

Example 1 was repeated with flux compositions as listed below. Similar satisfactory results were obtained.

| EXAMPLE 2 | |
|---|---|
| zinc chloride | 54% |
| potassium chloride | 26% |
| sodium chloride | 10% |
| sodium bisulphate | 10% |

| EXAMPLE 3 | |
|---|---|
| zinc chloride | 54% |
| potassium chloride | 22% |
| sodium chloride | 9% |
| potash alum | 15% |

| EXAMPLE 4 | |
|---|---|
| zinc chloride | 49% |
| calcium chloride | 10% |
| potassium chloride | 22% |
| sodium chloride | 9% |
| sodium bisulphate | 10% |

| EXAMPLE 5 | |
|---|---|
| zinc chloride | 59% |
| potassium chloride | 26% |
| sodium chloride | 10% |
| hydrochloric acid | 5% |

We claim as our invention:

1. A galvanising flux solution which is a 3 to 30 percent by weight solution in water of a galvanising flux consisting essentially of i. at least 25 percent by weight of zinc chloride, ii. at least one chloride selected from the class consisting of sodium, potassium, calcium and magnesium chloride and iii. at least one acid salt which when dissolved in water at a concentration of 1.25 percent by weight give a solution having a pH of less than 5, the proportions and ingredients being such that when such a flux is placed in water at a concentration of 25 percent by weight, the pH of the solution is less than 5.

2. The flux of claim 1 which additionally contains up to 20 percent by weight of at least one component selected from the class consisting of zinc ammonium chloride and ammonium chloride.

3. The flux of claim 1 including an amount of up to 1 percent by weight of a surfactant.

4. The flux of claim 1 and including an amount of up to 1 percent by weight of a flocculating agent.

5. The flux solution of claim 1 wherein component (iii) is selected from the group consisting of aluminum sulphate, soda alum and potash alum, potassium bisulphate, sodium bisulphate, aniline hydrochloride, ferrous chloride, ferric chloride, sodium aluminum chloride, triethanolamine hydrochloride, and aluminum chloride.

6. In the process of hot dip galvanising which comprises covering the surface of a ferrous metal article with a flux solution, optionally drying the article so as to leave a layer of flux on the surface of the article, immersing the article in molten zinc or zinc alloy, removing the article therefrom and allowing the molten zinc or zinc alloy on the surface of the article to solidify, the improvement which comprises using as flux solution an aqueous solution of a galvanising flux consisting essentially of i. at least 25 percent by weight of zinc chloride, ii. at least one chloride selected from the class consisting of sodium, potassium, calcium and magnesium chloride and iii. at least one acid salt which when dissolved in water at a concentration of 1.25 percent by weight give a solution having a pH of less than 5, the proportions and ingredients being such that when such a flux is placed in water at a concentration of 25 percent by weight, the pH of the solution is less than 5.

7. The process of claim 6 wherein component (iii) is selected from the group consisting of aluminum sulphate, soda alum and potash alum, potassium bisulphate, sodium bisulphate, aniline hydrochloride, ferrous chloride, ferric chloride, sodium aluminum chloride, triethanolamine hydrochloride, and aluminum chloride.

* * * * *